United States Patent [19]

Willard et al.

[11] Patent Number: 4,819,793

[45] Date of Patent: Apr. 11, 1989

[54] BEVERAGE CARRIER

[75] Inventors: Charles Willard, Penngrove; Roy Fong, San Francisco, both of Calif.

[73] Assignee: Charles, Fong and Associates, San Francisco, Calif.

[21] Appl. No.: 108,072

[22] Filed: Oct. 13, 1987

[51] Int. Cl.[4] ..... A45G 11/20; F25D 3/08; B65D 25/28; B65D 33/06

[52] U.S. Cl. ..... 206/162; 206/541; 62/457; 383/17; 383/20; 383/40; 383/38; 383/110

[58] Field of Search ..... 383/17, 20, 40, 38, 383/104, 106, 110; 217/128-131; 206/146, 162, 541, 548, 542, 216, 549; 62/457

[56] References Cited

U.S. PATENT DOCUMENTS

| | | | |
|---|---|---|---|
| 565,508 | 8/1896 | Rothenbach | 217/128 X |
| 736,916 | 8/1903 | Flinder | 206/162 X |
| 1,223,420 | 4/1917 | Pomper | 383/104 X |
| 1,983,418 | 12/1934 | Thurmer | 383/38 X |
| 2,089,297 | 8/1937 | Read et al. | 383/38 X |
| 2,112,406 | 3/1938 | Metro | 383/38 |
| 2,473,429 | 6/1949 | Hinman | 206/162 |
| 2,504,911 | 4/1950 | Whitecar | 62/95 |
| 2,730,151 | 1/1956 | Smith | 383/40 X |
| 3,387,650 | 6/1968 | Hoffman et al. | 165/75 |
| 3,401,535 | 9/1968 | Palmer | 62/457 |
| 3,462,010 | 8/1969 | Hamilton et al. | 206/146 |
| 3,974,568 | 8/1976 | Starrett | 62/60 |
| 4,050,264 | 9/1977 | Tanaka | 62/457 |
| 4,065,336 | 12/1987 | Conklin | 156/69 |
| 4,280,336 | 7/1981 | Taylor | 206/541 X |
| 4,340,138 | 7/1982 | Bernhardt | 206/216 |
| 4,403,483 | 9/1983 | Lisalda | 62/457 |
| 4,468,933 | 9/1984 | Christopher | 383/40 X |
| 4,499,999 | 2/1985 | Behar | 206/541 X |
| 4,530,220 | 7/1985 | Nambu et al. | 62/530 |
| 4,542,826 | 9/1985 | Adams | 383/38 X |
| 4,708,248 | 11/1987 | Davis | 383/38 X |

FOREIGN PATENT DOCUMENTS

| | | | |
|---|---|---|---|
| 3116198 | 11/1982 | Fed. Rep. of Germany | 62/457 |
| 1124731 | 8/1968 | United Kingdom | 383/17 |

*Primary Examiner*—William Price

*Attorney, Agent, or Firm*—Douglas A. Chaikin

[57] ABSTRACT

Disclosure herein is a beverage carrier having two basic embodiments. The first embodiment includes flexible water-resistant container having a flexible container with a bottom and upstanding walls and a top opening. The container further includes a removable flooring for supporting beverages in the container, nesting in the container adjacent the bottom. A separator is provided for spacing apart beverages in the container from one another. Another embodiment provides a like structure with the flooring having a coolant for cooling the beverages.

28 Claims, 4 Drawing Sheets

FIGURE 3
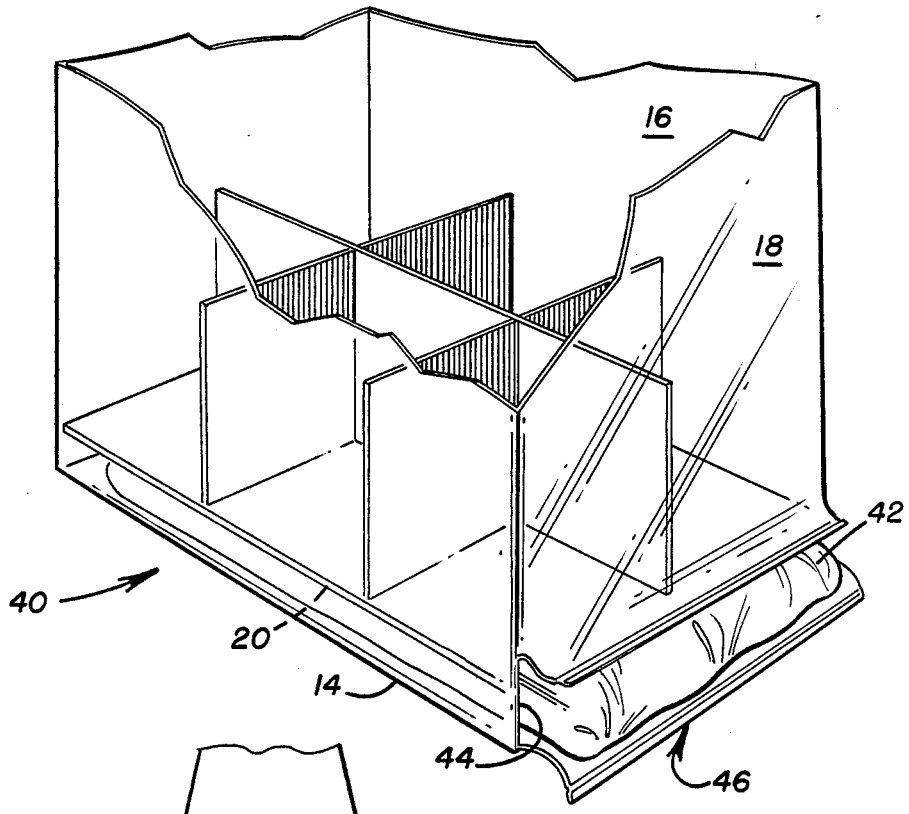
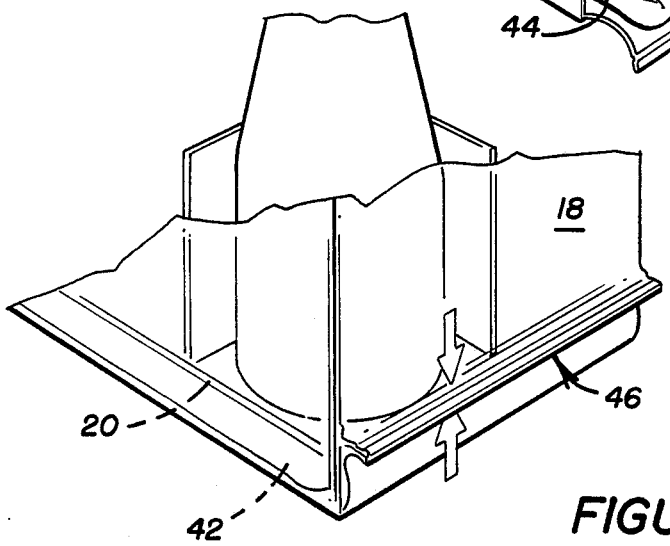
FIGURE 4

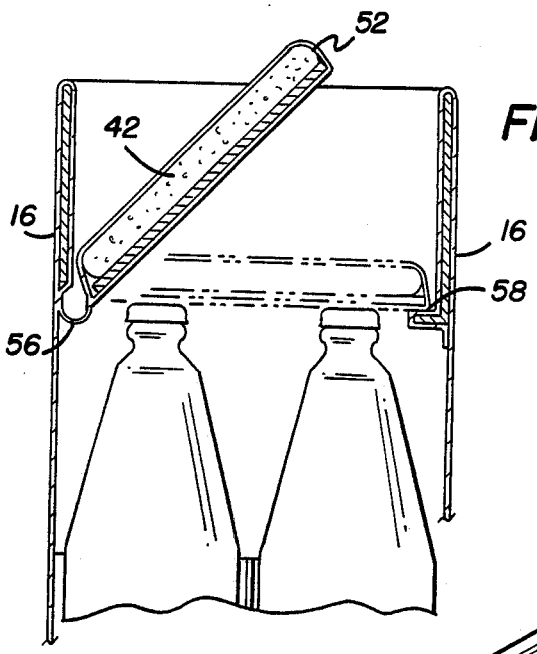
FIGURE 8
FIGURE 9
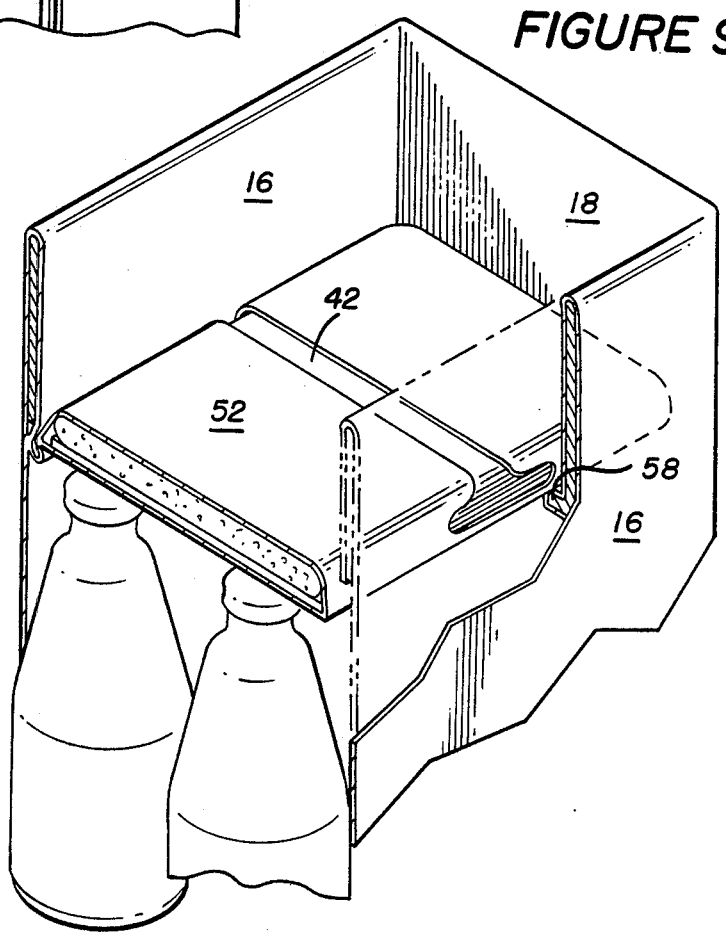

BEVERAGE CARRIER

BACKGROUND OF THE INVENTION

1. Field of the Invention

This invention relates to beverage carriers and more particularly to beverage carriers which are capable of including means for cooling the beverages.

2. Previous Art

The traditional beverage carrier consists of a cardboard box with an egg crate-type structure for holding the beverages. The typical "six pack" used by almost every manufacturer, bottler and distributor of beer and soda pop uses this type of carrier. Very often the carrier becomes soaked with the beer or soda as it cools down and forms condensation or sweats. Spills or the like which are quite common and cause moisture to be absorbed by the cardboard. The cardboard typically absorbs the sweat or condensation from the beverages and weakens structurally. The carrier may weaken so much that it can no longer hold the beverages and if they are bottles they may fall from the carrier and break. The glass shrouds produced from such a fall are clearly a hazard to the user and those around him. Additionally, the carrier will have failed in its only function, namely, to carry the beverages.

Others have produced rather expensive and bulky totes for beverages and other articles. These totes are in effect a miniature picnic box. They are capable of and are often used in conjunction with cooling devices such as bags of cooling gels or frozen plastic bars or ice. For example, a company selling under the trade name Igloo sells such totes under the mark "Playmate" for approximately $15.00. The container of the Playmate is made of durable and heavy weight plastic and clearly not suitable for use as a general distribution item by the manufacturers, bottlers and distributors of beer and soda pop. The cost of the container would then be more than the beverages themselves. Additionally, the added weight and bulk for manufacturers, bottlers and distributors would be unsatisfactory for shipping.

What is needed is a novel beverage carrier which performs the same function as the traditional cardboard egg crate-type beverage carrier and which is capable of housing coolant so that the beverages carried by such a carrier remain or are brought to the desired temperature.

SUMMARY OF THE INVENTION

It is an object of this invention to provide a beverage carrier which maintains its strength even when filled and even under adverse circumstances.

It is a further object of this invention to provide a beverage carrier as set forth above which is lightweight and is easy to carry.

It is a further object of this invention to which provide a beverage carrier which is capable of conveniently carrying other articles besides beverages and which is capable of providing cooling to either one or both of the beverages or other articles.

In accordance with the above objects and those that will be mentioned and will become apparent below, the beverage carrier of the instant invention includes:

a flexible container having a bottom and upstanding walls and a top opening, the container being made from water-resistant material;

flooring means for supporting beverages in the container, nesting in the container adjacent the bottom; and separator means for spacing apart beverages in the container from one another.

While the above described carrier does not include coolant, it does overcome a primary flaw in the traditional carrier in that the container is water resistant. It also accomplishes all of the advantageous features of the traditional carrier.

Another embodiment of the beverage carrier of the invention includes:

a flexible container having a bottom and upstanding side walls and a top opening;

flooring means for supporting beverages in the container, nesting compatibly adjacent the bottom;

means for cooling the beverages in the container, located between the bottom and the flooring means; and separator means for spacing apart beverages in the container from one another.

Yet another embodiment of the beverage carrier of the invention includes:

a flexible container having a bottom and upstanding side walls and a top opening;

flooring means for supporting beverages in the container, nesting in the container adjacent the bottom;

ceiling means over the tops of beverages in the container for separating the beverages from the top opening and for providing a support for other articles;

means for cooling the beverages and other articles in the container, located between the bottom and the flooring means and within the ceiling means; and separator means for spacing apart beverages in the container from one another, whereby, beverages rest and are cooled in that portion of the container adjacent the bottom and other articles rest upon and are cooled by the ceiling means with cooling means.

And still another embodiment of the beverage carrier of the invention includes:

a flexible container having a bottom and upstanding side walls and a top opening;

a first flooring means for supporting beverages in the container, nesting in the container adjacent the bottom, and a second flooring means above the beverages for supporting other articles;

ceiling means for closing the top opening;

means for cooling the beverages and other articles in the container, located between the bottom and the flooring means and within the ceiling means; and separator means for spacing apart beverages in the container from one another, whereby, beverages rest and are cooled in that portion of the container adjacent the bottom and other articles rest upon and are cooled by the ceiling means with cooling means.

And still another embodiment of the beverage carrier of the invention includes:

a flexible container having a bottom and upstanding side walls and a top opening;

a first flooring means for supporting beverages in the container, nesting in the container adjacent the bottom, and a second flooring means above the beverages for supporting other articles;

ceiling means for closing the top opening;

means for cooling the beverages and other articles in the container, located between the bottom and the flooring means and within the ceiling means; and separator means for spacing apart beverages in the container from one another, whereby, beverages rest and are cooled in that portion of the container adjacent the bottom and other articles rest upon and are cooled by the ceiling means with cooling means.

The later three embodiments do not necessarily include the container being made from water resistant material as matter of being inventive. However, it will be appreciated that it is preferred that the container is made from a clear, light weight plastic such as polyethylene, which is commonly available and which of course is water resistant.

It is an advantage of this invention to carry beverages in a carrier which will not fall apart upon continued contact with water and which will not become a safety hazard.

It is an additional advantage of this invention to provide a carrier that will hold more than just beverages conveniently, while keeping both the beverages and the other articles cool.

Further objects and advantages of this invention will become obvious with reference to the further description of the invention with respect to the drawing.

BRIEF DESCRIPTION OF THE DRAWING

FIG. 3 is an elevated top partial sectional view showing a second embodiment of a beverage container in accordance with this invention.

FIG. 4 is an elevated partial sectional perspective view of the embodiment shown in FIG. 3.

FIG. 8 is an elevated partial sectional perspective side view of another embodiment of a beverage carrier in accordance with this invention.

FIG. 9 is an elevated partial sectional view of the embodiment shown in FIG. 7.

DETAILED DESCRIPTION OF THE INVENTION

The invention includes a beverage carrier with and without means for cooling the beverages. The embodiments that include means for cooling the beverages, may have one to three separate areas of cooling within the container. All of these embodiments fall within the same general inventive entity while representing separate and distinct inventive concepts.

Figure 1:
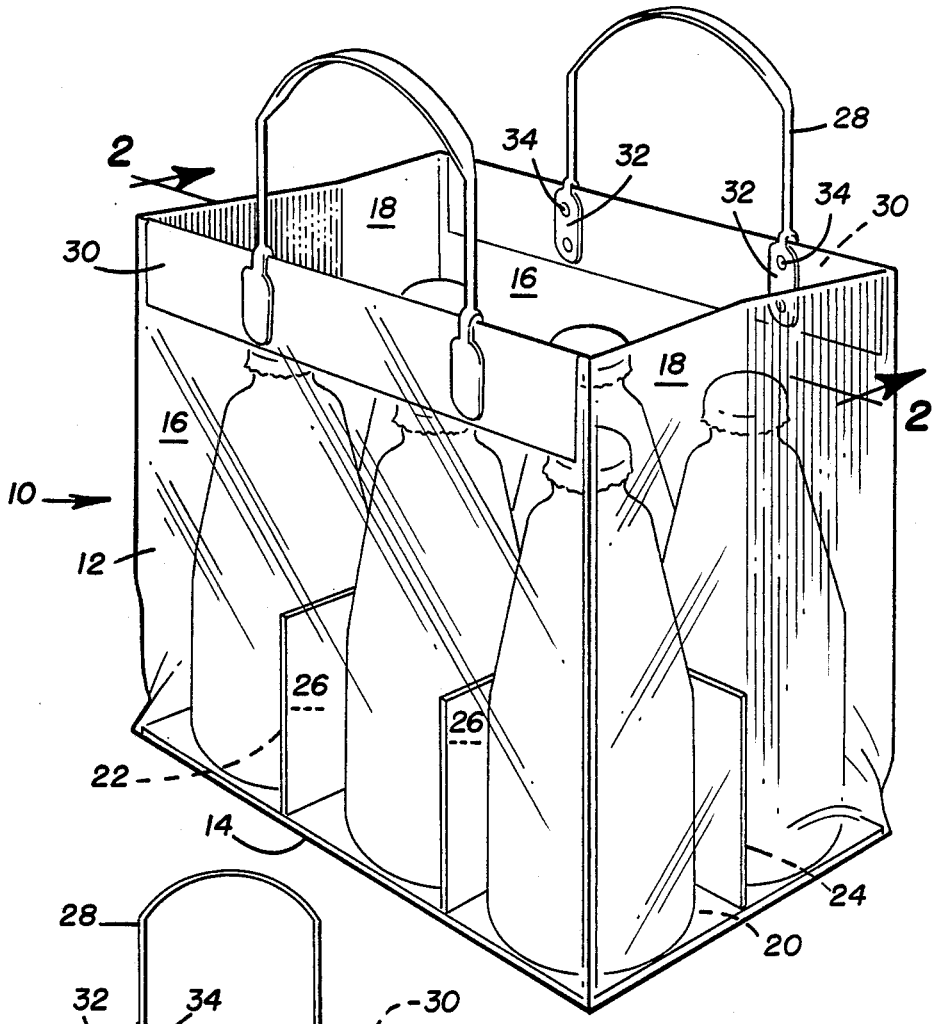
FIG. 1 is an elevated perspective view of one embodiment of a beverage carrier in accordance with this invention.
Figure 2:
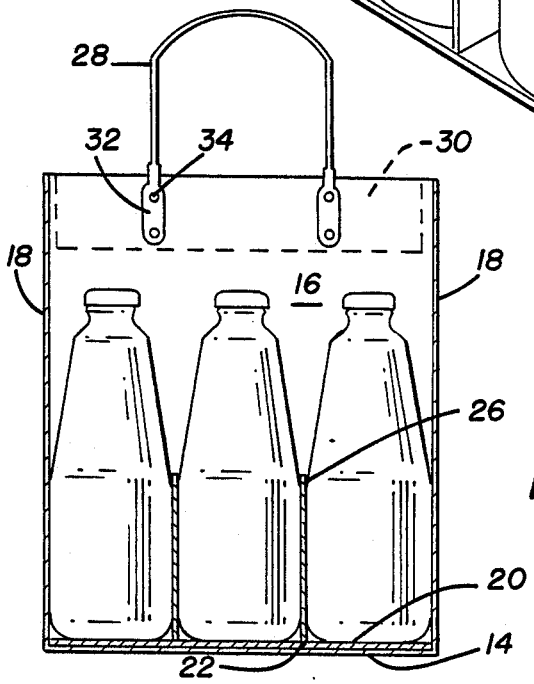
FIG. 2 is an elevated side plan view illustrating the embodiment shown in FIG. 1 taken along line 2—2 of FIG. 1 and looking in the direction of the arrows.

The invention will now be described with respect to the drawing wherein like reference characters designate like or corresponding parts throughout the several views. Referring particularly to FIGS. 1 and 2, there is shown the invention, a beverage carrier, generally indicated by numeral 10. The beverage carrier 10 includes a flexible container 12.

The container 12 is made from a strong and flexible clear plastic, such as polyethylene. The plastic may also be double walled to promote greater insulation, especially in the later described embodiments which include means for cooling and keeping the beverages cool. The container 12 has a bottom 14, front and back walls 16 and side walls 18. The walls are generally upstanding, but it will be appreciated that if they were not connected together, they would not be upstanding. For example, side walls 18 will not be upstanding without front and back walls 16. In this embodiment the walls 16 and 18 define an open top.

The container 12 further includes a flooring 20. The flooring 20 supports beverages in the container 12. The flooring 20 is sized and shaped to nest in the container 12 against the bottom 14. The flooring 20 is made from a light weight and relatively rigid material, for example cardboard. The flooring 20 thus adds rigidity to container 12 while maintaining an overall light weight carrier.

The beverages placed in the container 12 are often glass and therefore must be separated from one another to prevent breakage. The carrier 10 includes an egg crate-type separator structure 22 for separating one beverage from the other. The separator 22 has a first member 24 extending from one side wall 18 to the other. The separator 22 includes two other members 26 which extend from the front to back walls 16, and intersect the first member 24 approximately half way between said walls 16. The separator 22 is also made of a light weight material, for example cardboard.

The carrier 10 includes handles 28 for carrying about the container 12, even when full. The top portion of the front and back walls 16 include reinforcing members 30. The handles 28 are one piece and include fastening members 32 at each end. The fastening members 32 have a pair of male inserts 34 which are pushed through openings (not shown) in the walls 16 and the reinforcing members 32. The fastening members 32 have a female connection zone 34 for compatible connection with the male inserts 34. Once the male inserts 34 are pushed completely through the walls 16 and the members 30, they are connected and locked by the female connection zone 34. The beverage carrier 10 may then be carried about by one hand of the user.

Referring particularly to FIGS. 3 and 4, there is shown another embodiment of the beverage carrier in accordance with this invention generally designated by the numeral 40. The beverage carrier 40 is virtually the same as beverage carrier 10 with the addition of the means for cooling the beverages and with the changes as noted below.

The beverage carrier 40 includes the flooring 20 spaced above the bottom 14. The flooring 20 rests upon a flexible bag-type refrigerated coolant 42. The coolant 42 is conventional and may be found in hardware or grocery-type stores. For example, a suitable coolant is sold under the registered trademark "Blue Ice" and available through Pelton Shepherd Industries.

To allow easy access of the coolant 42, the one of the front or back walls 18 has an opening 44 adjacent the bottom 14. The coolant 42 is slipped inside the container 12 by opening the opening 44. The opening 44 is opened and sealed by means of a zipper-type lock 46 having male and female end which is pushed together to close and seal.

Figure 5:
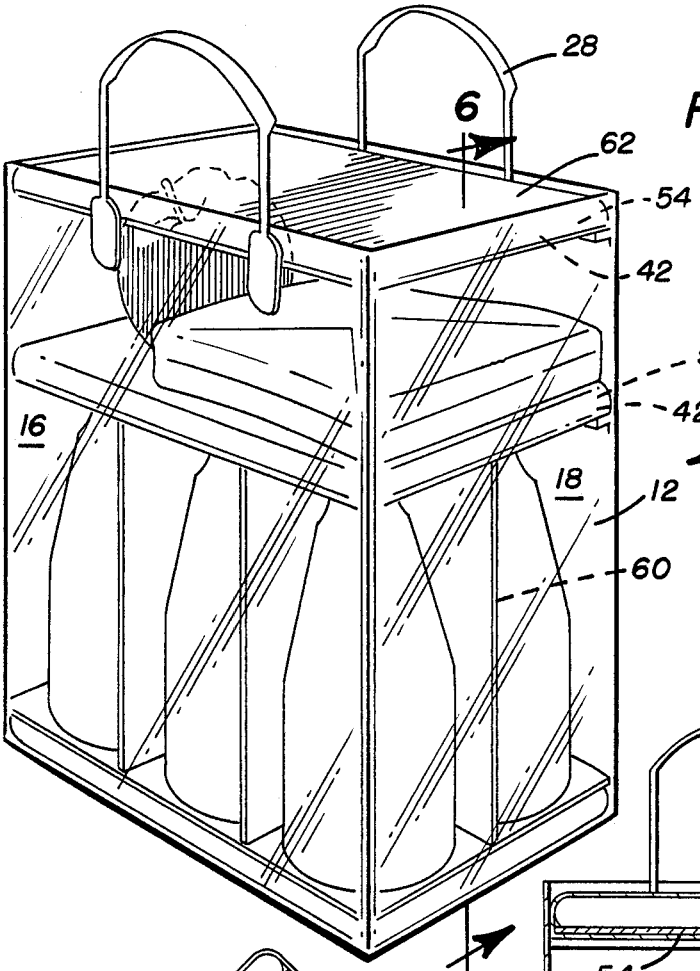
FIG. 5 is an elevated perspective view of another embodiment of a beverage carrier in accordance with this invention.
Figure 6:
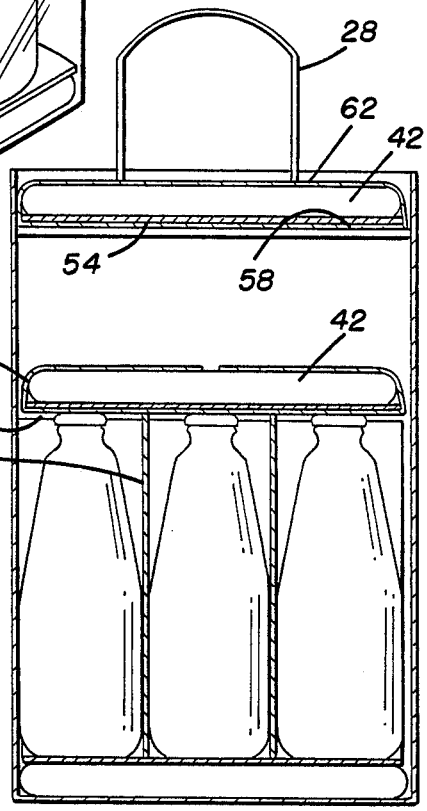
FIG. 6 is an elevated side plan view illustrating the embodiment shown in FIG. 5 taken along line 6—6 of FIG. 5 and looking in the direction of the arrows.
Figure 7:
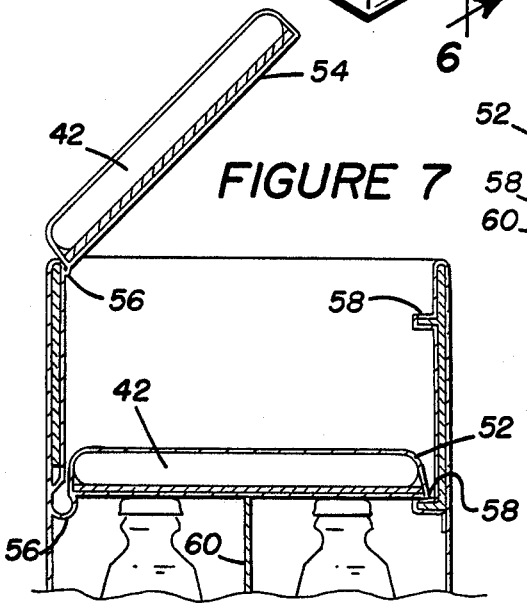
FIG. 7 is an elevated partial sectional side plan view illustrating the hinging capability of the embodiment shown in FIG. 6.

Referring particularly to FIGS. 5–7, there is shown another embodiment of the beverage carrier in accordance with this invention generally designated by the numeral 50. The beverage carrier 50 is virtually the same as previously described beverage carriers 10 and 40 with the addition of the additional means for cooling the beverages and with the changes as noted below.

The beverage carrier 50 includes a mid-level flooring 52 and a ceiling 54 for enclosing the container 12. The mid-level flooring 52 defines a structure for holding coolant 42. The beverage carrier 50 includes coolant 42 held by the flooring 52 and slideably removable therefrom. In practice, the mid-level flooring 52 rests upon the tops of the beverages in the container 12 and thereby defines a ceiling for said beverages.

The flooring 52 serves to keep the beverages cool by sealing off the beverages from a warmer outside environment. The flooring 52 also serves to keep the beverages clean by providing a barrier with the outside environment. Dirt and sand and the like are not able to enter the container when the flooring 52 encloses the container 12 at approximately mid-level as shown most clearly in FIGS. 6–9.

The flooring 52 is hingedly connected to one of the front or back walls 18 as best shown in FIGS. 8 and 9. The front and back walls 18 are double reinforced to promote durability of the carrier 50. A hinge 56 connects the flooring 52 to the double reinforced side wall 18. The double reinforcing of the side wall 18 is formed by folding over the side wall 18 against itself. Additional reinforcement is provided by the insertion of cardboard 57 or similar lightweight material such as a lightweight plastic between the folds. The hinge 56 extends approximately from the front to back walls 18. A seating member 58 is formed on the opposing side wall 18 and extends likewise from the front to the back walls 18. The seating member 58 acts as a stop means in case there are no beverages in the carrier 50.

The carrier 50 includes an egg crate-type separator 60, quite similar to the earlier described separator 22. The separator 60 functions in much the same way as the separator 22 with the exception that the separator 60 is a full height separator compared with the half-height separator 60. The full height separator 60 also assists in supporting the flooring 52 with or without beverages present in the carrier 50.

As mentioned earlier, the carrier 50 includes a ceiling 54 for enclosing the container 12. The ceiling 54 is hingedly connected to one of the back or front walls 16 as shown in FIG. 7. As earlier described with respect to flooring 52, a hinge 56 connects the ceiling 54 to the double reinforced back wall 16.

Similar to the flooring 52, the ceiling 54 defines a structure for holding coolant 42. The coolant 42 is slidably held by the ceiling 54 in the same manner as that earlier described with respect to the flooring 52. Once the ceiling is closed the carrier 50 is fully enclosed, promoting a high degree of cooling within the container 12.

It will be appreciated by those skilled in the art that the flooring 52 may optionally not include the coolant 42. In that case the flooring 52 need only consist of a single layer flooring. Of course, in that embodiment, a double layer embodiment may prove more desirable for insulation and supporting other articles such as fruit and sandwiches.

In Use

Beverages such as beer or soda pop or other liquid drinks may be stored and carried by the carriers 10 and 50 of this invention. If the beverages are cold they will continue to remain so in the carrier 50. In fact beverages which are not suitable for drinking because they are not cold enough will become cold enough after being in the enclosed carrier 50 for a suitable period of time.

In order to place a beverage in the carrier 50, both the ceiling 54 and the flooring 52 are raised by their hinges 56 and opened sufficiently to allow the placing of beverages within the egg crate-type separator 60. The flooring 52 may then be closed and other articles such as fruit and sandwiches depicted in FIG. 5 may then be placed upon and supported by the flooring 52. The ceiling 54 may then be closed enclosing the entire container 12 for maximum cooling and protection from the environment.

After filling the beverage carrier 10 or 50, the user may then take it conveniently and easily wherever desired.

While the foregoing detailed description has described several embodiments of the beverage carrier in accordance with this invention, it is to be understood that the above description is illustrative only and not limiting of the disclosed invention. Particularly, a three level embodiment has been disclosed having coolant at each. It will be appreciated that any combination of levels either containing coolant or not is also within the scope and spirit of this invention. Thus the invention is to be limited only by the claims as set forth below.

What is claimed is:

1. A beverage carrier, comprising:

a flexible container having a bottom and upstanding side walls and a top opening;

flooring means for supporting beverages in the container, nesting compatibly adjacent the bottom;

means for cooling the beverages in the container, located between the bottom and the flooring means; and separator means for spacing apart beverages in the container from one another.

2. A beverage carrier as set forth in claim 1, wherein the container is made from a water-resistant material.

3. A beverage carrier as set forth in claim 1, wherein the container includes handle means for carrying the container.

4. A beverage carrier as set forth in claim 1, wherein the container side walls include reinforcement and the handle means are connected to the side walls at the reinforcement.

5. A beverage carrier as set forth in claim 1, wherein the side walls are clear.

6. A beverage carrier as set forth in claim 4, wherein the container is made of plastic.

7. A beverage carrier as set forth in claim 1, wherein the walls are double walled to promote insulation and retention of cooling.

8. A beverage carrier, comprising:

a flexible container having a bottom and upstanding side walls and a top opening;

flooring means for supporting beverages in the container, nesting in the container adjacent the bottom;

ceiling means over the tops of beverages in the container for separating the beverages from the top opening and for providing a support for other articles;

means for cooling the beverages and other articles in the container, located between the bottom and the flooring means and within the ceiling means; and separator means for spacing apart beverages in the container from one another, whereby, beverages rest and are cooled in that portion of the container adjacent the bottom and other articles rest upon and are cooled by the ceiling means with cooling means.

9. A beverage carrier as set forth in claim 8, wherein the container is made from a water-resistant material.

10. A beverage carrier as set forth in claim 8, wherein the container includes handle means for carrying the container.

11. A beverage carrier as set forth in claim 8, wherein the container front and back walls include reinforcement and the handle means are connected to the side walls at the reinforcement.

12. A beverage carrier as set forth in claim 8, wherein the side walls are clear.

13. A beverage carrier as set forth in claim 9, wherein the container is made of plastic.

14. A beverage carrier as set forth in claim 8, wherein the ceiling means is connected to at least one of front or back walls.

15. A beverage carrier as set forth in claim 8, wherein the ceiling means is supported by the tops of beverages in the container.

16. A beverage carrier as set forth in claim 8, wherein the ceiling means is hingedly connected to one of the front or back walls of the container.

17. A beverage carrier as set forth in claim 8, wherein the walls are double walled to promote insulation and retention of cooling.

18. A beverage carrier as set forth in claim 16, wherein the separator means extends from the bottom of the container to the ceiling means and supports the ceiling means upon closure of the ceiling means.

19. A beverage carrier, comprising:

a flexible container having a bottom and upstanding side walls and a top opening;

a first flooring means for supporting beverages in the container, nesting in the container adjacent the bottom, and a second flooring means above the beverages for supporting other articles;

ceiling means for closing the top opening;

means for cooling the beverages and other articles in the container, located between the bottom and the flooring means and within the ceiling means; and separator means for spacing apart beverages in the container from one another, whereby, beverages rest and are cooled in that portion of the container adjacent the bottom and other articles rest upon and are cooled by the ceiling means with cooling means.

20. A beverage carrier as set forth in claim 19, wherein the container is made from a water-resistant material.

21. A beverage carrier as set forth in claim 19, wherein the container includes handle means for carrying the container.

22. A beverage carrier as set forth in claim 19, wherein the container side walls include reinforcement and the handle means are connected to the side walls at the reinforcement.

23. A beverage carrier as set forth in claim 19, wherein the side walls are clear.

24. A beverage carrier as set forth in claim 19, wherein the container is made of plastic.

25. A beverage carrier as set forth in claim 19, wherein the ceiling means is hingedly connected to one of the front or back walls.

26. A beverage carrier as set forth in claim 19, wherein the ceiling means is supported by the tops of beverages in the container.

27. A beverage carrier as set forth in claim 19, wherein the ceiling means is hingedly connected to one side walls of the container.

28. A beverage carrier as set forth in claim 19, wherein the walls are double walled to promote insulation and retention of cooling.

* * * * *